United States Patent [19]

Hacker et al.

[11] Patent Number: 4,977,761

[45] Date of Patent: Dec. 18, 1990

[54] LIQUOR APPLYING NOZZLE FOR A TEXTILE DYEING MACHINE

[75] Inventors: George G. Hacker; James K. Turner, both of Stanley; Charles R. Hornbuckle, Lincolnton, all of N.C.

[73] Assignee: Gaston County Dyeing Machine Co., Stanley, N.C.

[21] Appl. No.: 465,465

[22] Filed: Jan. 16, 1990

[51] Int. Cl.[5] ..... D06B 3/28

[52] U.S. Cl. ..... 68/177

[58] Field of Search ..... 68/177, 178

[56] References Cited

U.S. PATENT DOCUMENTS

| | | | |
|---|---|---|---|
| 3,685,325 | 8/1972 | Carpenter | 68/177 |
| 3,762,189 | 10/1973 | Marsh et al. | 68/177 |
| 3,952,558 | 4/1976 | Sandberg et al. | 68/177 |
| 4,129,017 | 12/1978 | Greer | 68/177 X |

FOREIGN PATENT DOCUMENTS

| | | | |
|---|---|---|---|
| 2714801 | 12/1977 | Fed. Rep. of Germany | 68/177 |
| 0134878 | 3/1979 | German Democratic Rep. | 68/178 |
| 757921 | 9/1956 | United Kingdom | 68/177 |

*Primary Examiner*—Philip R. Coe

*Attorney, Agent, or Firm*—Shefte, Pinckney & Sawyer

[57] ABSTRACT

A liquor applying nozzle has a hollow tubular frame surrounding the path of a textile rope circulating in a textile dyeing machine to provide an opening having an elongated, generally straight, transversely extending bottom, a transversely extending top surface spaced from the bottom, and a pair of spaced, upstanding, generally straight side surfaces. Dye liquor is distributed through the hollow interior of the frame to lower and upper orifices extending across the bottom and top surface of the frame. The nozzle further includes an enclosure portion extending downstream from the tubular frame and upper and lower plate-like members that extend in spaced relation to the enclosure portion and are adjustable with respect thereto to adjustably define the size of the orifices.

19 Claims, 6 Drawing Sheets

LIQUOR APPLYING NOZZLE FOR A TEXTILE DYEING MACHINE

BACKGROUND OF THE INVENTION

The present invention relates to a liquor applying nozzle for a textile dyeing machine, and more particularly to such a nozzle for use in a piece dyeing machine in which the nozzle is arranged for travel of a textile rope therethrough for applying dye liquor to the rope as it circulates within the machine.

Nozzles of this general type have long been in use in piece dyeing machines. Generally such nozzles are tubular with a circular cross-section in which the textile rope is confined as it travels from a lifter reel to a return tube from which the rope is discharged to form in folds in a plug that progresses through a dyeing chamber from the return tube to the lifter reel.

With most types of textile fabrics, a circular nozzle of this type is effective under normal operating circumstances. However, with heavy or bulky fabrics, such as heavy and wide carpet fabric, it is preferable to have the fabric open width-wise as much as possible for effective application of dyeing liquor, and a circular shape tends to compact the material rather than allowing it to open.

Attempts have been made to design nozzles having an elongated width-wise extent for this purpose. For example, an oval-shaped nozzle has been used in machines for dyeing heavy carpet fabric. However, even with an oval-shaped nozzle there is a tendency for the fabric to be restricted in a compact condition rather than being as open as possible.

By the present invention, a nozzle is provided that opens the fabric to the greatest extent possible for effective application of dye liquor.

SUMMARY OF THE INVENTION

Briefly described, the liquor applying nozzle of the present invention is incorporated in a textile dyeing machine in which textile material, such as fabric, is circulated in rope form through a dyeing chamber and wherein the rope progresses in folded plug form through the chamber and is withdrawn from the leading end of the plug in a path extending over a lifter reel, through a liquor applying nozzle and a return passage from which it reforms as the trailing end of the progressing folded plug. This nozzle includes a frame surrounding the path of the textile rope and having an opening through which the textile rope passes. Means are provided for introducing treating liquor through the frame into the opening and onto the textile rope. The opening is defined by an elongated, generally straight, transversely extending surface forming the textile rope supporting bottom of the opening. A transversely extending top surface is spaced from the bottom surface and a pair of spaced, upstanding, generally straight side surfaces extend between the bottom and top surfaces, with the generally straight bottom and side surfaces combining to facilitate disposition of the textile rope in generally open condition across the transverse extent of the opening. The elongated, generally straight bottom surface allows the fabric to travel in a generally open condition and the upstanding, generally straight side surfaces allow the bottom surface to extend to substantially the full width of the opening and to an extent within the design limits of the machine without causing the fabric to fold over upon itself and become compacted toward the center, as is the case with a circular or oval opening shape.

Preferably, the frame is hollow for distribution of liquid therethrough, and the liquor introducing means includes a lower orifice extending transversely across the opening along the bottom surface thereof for flow of liquid therethrough into contact with the textile rope. Preferably, the lower orifice faces generally downstream to direct the liquor in a rope transporting direction, and the size of the lower orifice is adjustable in the direction of the rope path to provide for increased or decreased liquor flow from the nozzle.

The nozzle, in one form, includes an enclosure portion extending downstream from the lower orifice for enclosing the rope. This enclosure portion includes a generally flat lower portion extending downstream from the lower edge of the lower orifice, and the liquor introducing means includes a plate-like member extending across the bottom of the opening and extending downstream above the flat lower portion and having a downstream edge defining the upper edge of the lower orifice. This plate-like member is adjustable to adjust the spacing between the downstream edge and the flat portion, thereby adjusting the size of the lower orifice. The flat portion preferably extends downstream at an upper inclination to direct liquor from the lower orifice at an inclination toward the rope.

In the preferred embodiment, there is, in addition to the lower orifice, an upper orifice extending transversely across the opening, with the upper and lower orifices being independently adjustable. An upper portion and an upper plate-like member are disposed in relation to the upper orifice in generally the same manner as the lower portion and lower plate-like member extend in relation to the lower orifice.

Preferably, the frame includes hollow tubular bottom, side and top portions on which the bottom, side and top surfaces are formed, with the bottom, side and top portions being connected to provide a liquor distribution plenum surrounding the path of the rope and communicating with the upper and lower orifices. The aforementioned upper flat portion of the enclosure extends inwardly into the top portion above the upper orifice to confine the flow and distribution of liquor thereunder to the upper orifice.

With the foregoing arrangement, liquor is generally uniformly distributed to the orifices and to the textile rope passing through the opening of the nozzle with the fabric being maintained in an open condition commensurate with the transverse extend of the nozzle.

Other and further features and advantages will be apparent from the accompanying drawings and following detailed description.

DETAILED DESCRIPTION OF THE PREFERRED EMBODIMENTS

Figure 1:
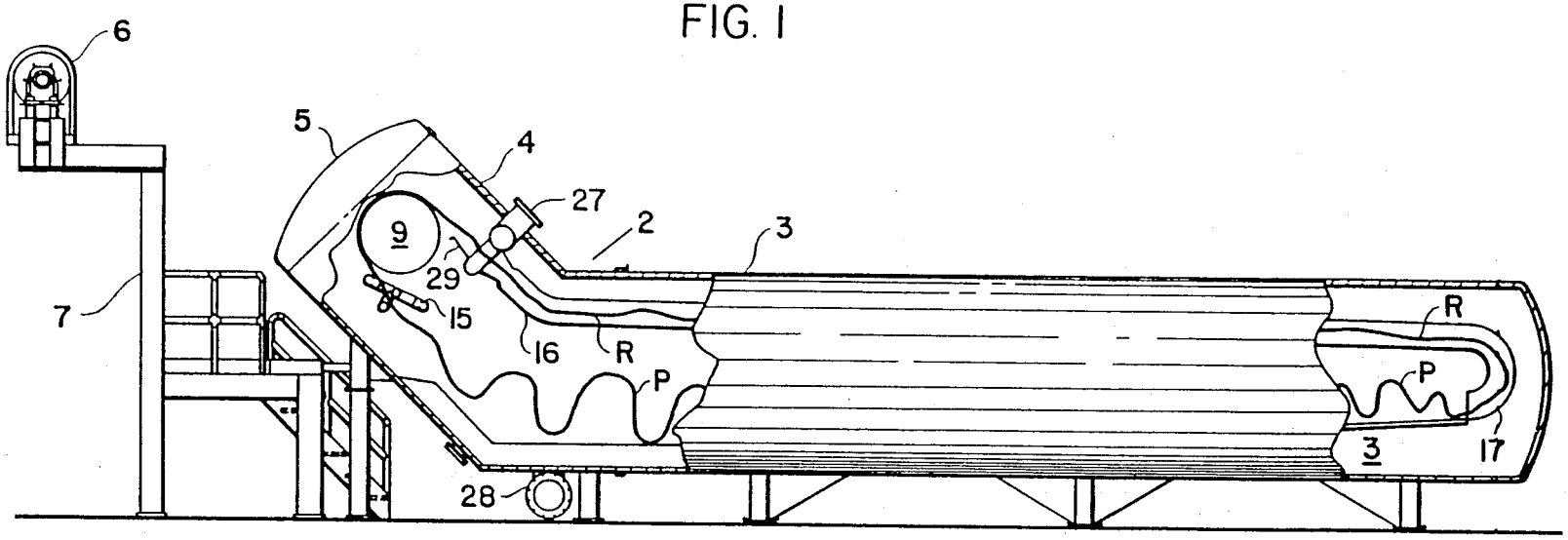
FIG. 1 is a side elevation, partially in schematic section, of a piece dyeing machine incorporating the liquor applying nozzle of the preferred embodiment of the present invention.
Figure 2:
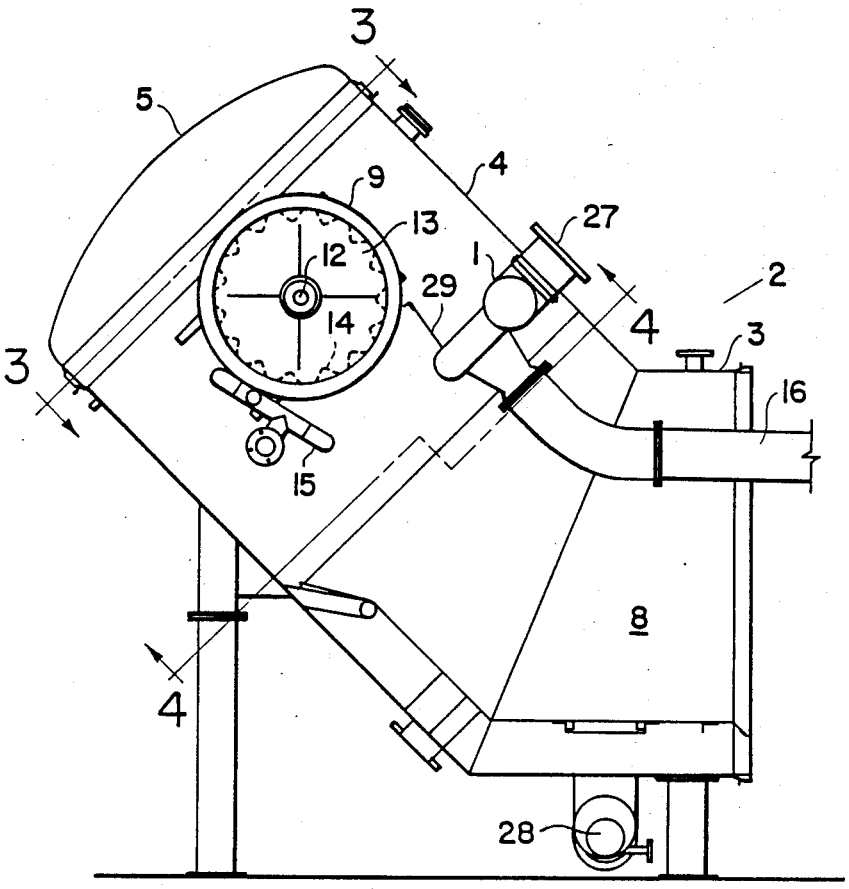
FIG. 2 is an enlargement of the left-hand portion of the machine of FIG. 1.
Figure 3:
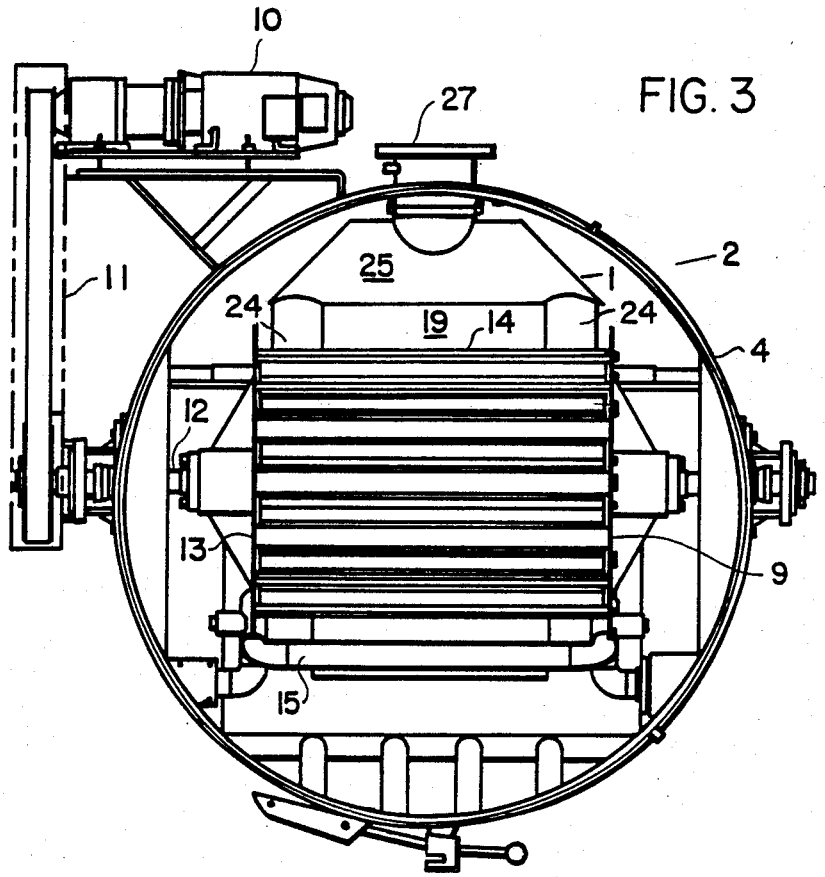
FIG. 3 is a sectional view taken along line 3—3 of FIG. 2.
Figure 4:
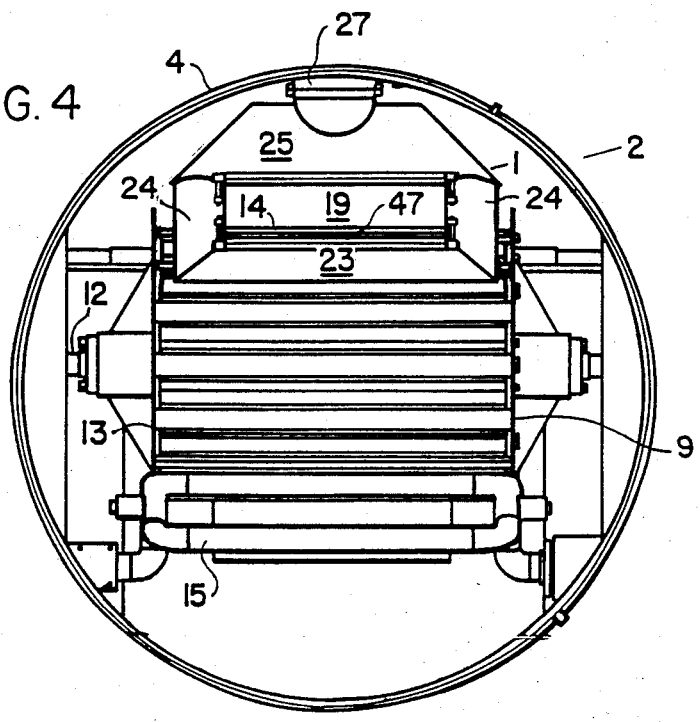
FIG. 4 is a sectional view taken along line 4—4 of FIG. 2.
Figure 5:
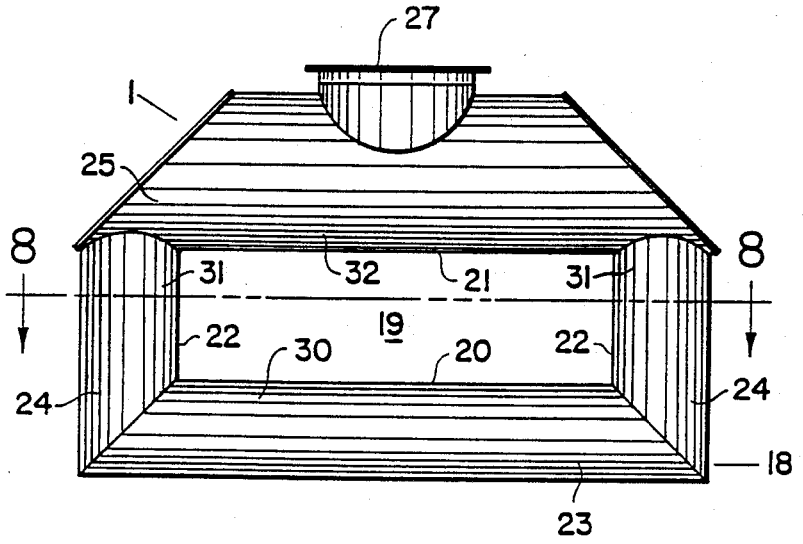
FIG. 5 is an elevational view of the upstream side of the liquid applying nozzle of the preferred embodiment of the present invention.
Figure 6:
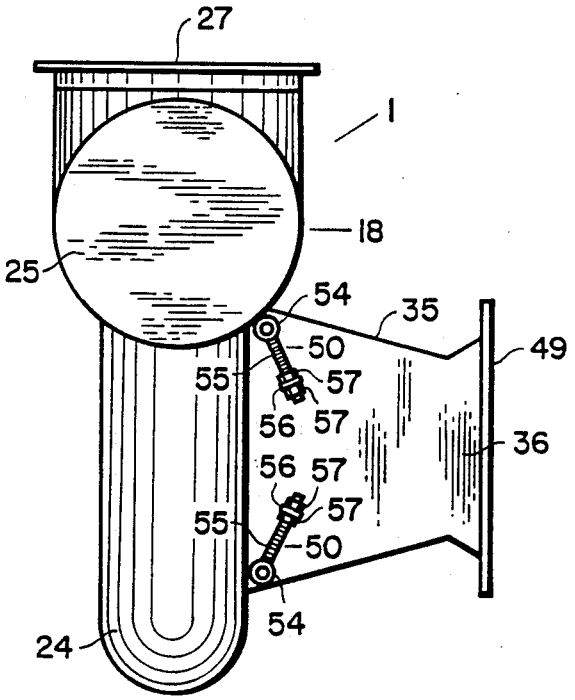
FIG. 6 is a side-elevation of the liquid applying nozzle of FIG. 5.
Figure 7:
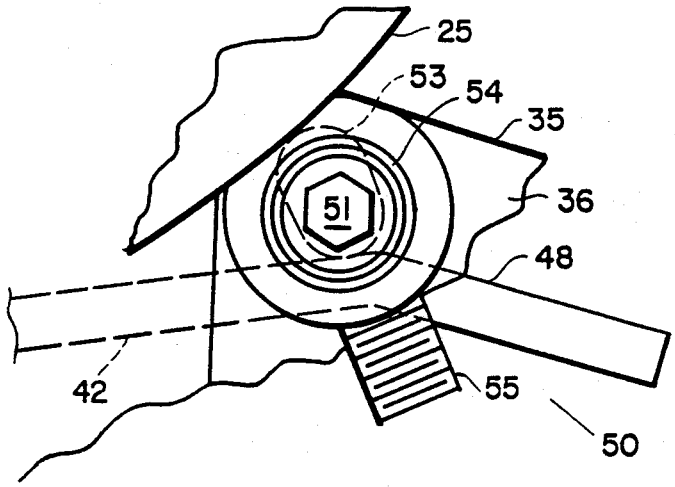
FIG. 7 is an enlargement of the adjusting mechanism of the liquid applying nozzle of FIG. 6.
Figure 8:
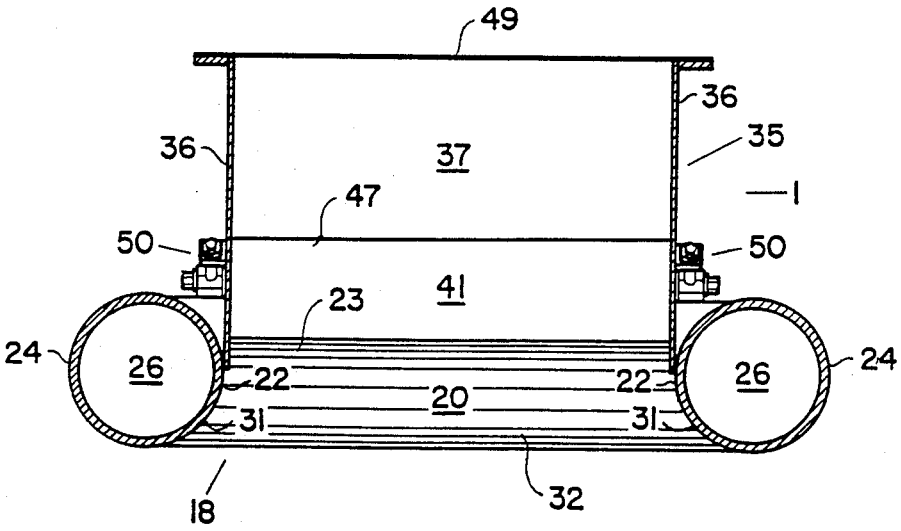
FIG. 8 is a sectional view taken along lines 8—8 of FIG. 5.
Figure 9:
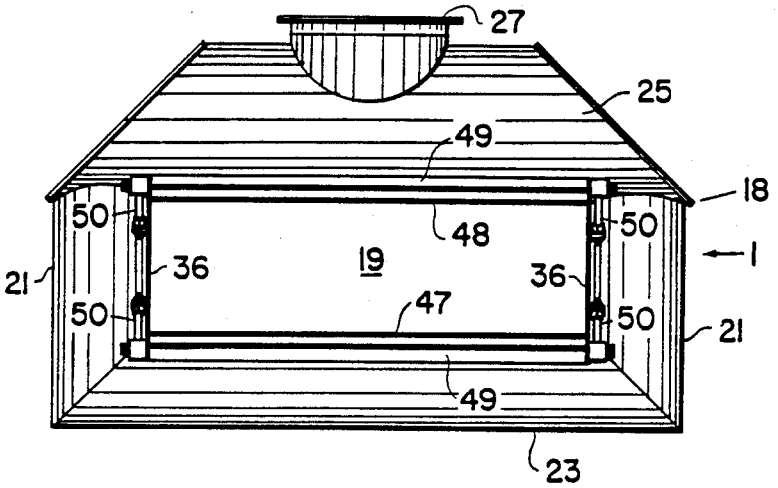
FIG. 9 is an elevational view of the downstream end of the liquid applying nozzle of the preferred embodiment of the present invention of FIG. 5.

As seen in the drawings, the liquor applying nozzle 1 of the preferred embodiment of the present invention is illustrated incorporated in a piece dyeing machine 2 of the long type, sometimes referred to as a "cigar" machine. The machine 2 is of a large capacity type capable of dyeing heavy textile fabrics, such as carpet material. The machine 2 includes a long generally horizontal housing 3 with an upwardly inclined forward section 4 having a cover 5 at its upper end through which fabric is fed into the machine 2 for loading and out of the machine 2 for unloading, using a guide roller mechanism 6 on a platform 7 in front of the machine 2.

The fabric is in the form of an endless rope R and circulates through the housing 3 in a main chamber 8 in the form of folds compacted into a plug P at least partially emersed in a dye bath in the housing 3. The plug P advances from the rear to the front where it is drawn by a large lifter reel 9 driven by a motor 10 mounted on the exterior of the housing 3, with a drive mechanism 11 drivingly connecting the motor 10 to the shaft 12 of the reel 9. The reel 9 is formed with spaced side plates 13, between which the fabric rope R is transported on V-shaped crossbars 14, which have their ends secured to the side plates 13.

The lifter reel 9 pulls the rope R from the leading end of the plug 2 through a guide eye 15, around the reel 9 and through the nozzle 1, from which the rope R is discharged into a return tube 16 for travel to the rear of the housing 3 at which it is directed by a guide plate 17 to form folds at the trailing end of the plug P for continued circulation in this manner through the machine 2.

It is in the above-described machine environment that the liquor applying nozzle 1 of the present invention is incorporated. This nozzle includes a frame 18 mounted in the wall of the housing 3 and extending into the forward section 4 in the path of the textile rope R. The frame 18 has an opening 19 through which the textile rope R passes. The opening 19 is defined by an elongated, generally straight, transversely extending surface that forms the textile rope supporting bottom 20 of the opening 19. The opening 19 also includes a transversely extending top surface 21 spaced from the bottom 20 and a pair of spaced, upstanding, generally straight side surfaces 22 extending between the bottom 20 and the top surface 21. The bottom 20 and generally straight side surfaces 22 combine to facilitate disposition of the textile rope R in generally open condition across the transverse extent of the opening 19.

The frame 18 is formed with hollow tubular bottom, side and top portions 23,24, and 25, respectively, on which the bottom, side and top surfaces 20,21 and 22, respectively, of the opening 19 are formed. These bottom, side and top portions 23,24,25 are connected to provide a liquor distribution plenum 26 surrounding the path of the rope R. A liquor receiving port 27 is formed in the top of the top portion 25 and communicates through the housing 3 with a source of supply of circulating liquor that is drawn from the bottom of the housing through a discharge port 28. The receiving port 27 is located centrally of the transverse extent of the top portion 25 for distribution across the top portion 25 generally uniformly to the side portion 24 and thereby to the bottom portion 23.

A guide plate 29 extends in the upstream direction from the bottom portion 23 to guide the textile rope R into the nozzle opening 19. In addition, the tubular shape of the bottom, side and top portions 23,24,25 provides upstream surfaces 30,31 and 32, respectively, curved inwardly toward the opening 19 for guiding the textile rope R into the opening 19.

Means are provided for introducing treating liquor through the frame 18 into the opening 19 and onto the textile rope R. This means includes a lower orifice 33 extending transversely across the opening 19 along the bottom 20 thereof, and an upper orifice 34 extending transversely across the opening 19 along the top portion 25 thereof. The lower and upper orifices 33,34 face generally downstream to direct the liquor in a rope transporting direction and are independently adjustable for adjusting the size of the orifices in the direction of the rope path, as will be described in detail below.

Extending in the downstream direction from the bottom, side and top portions 23,24,25 of the frame 18, is an enclosure portion 35 formed of two vertical side plates 36 extending downstream parallel to the path of the rope R tangentially with the frame side portions 24. The enclosure portion 35 also is formed with generally flat lower and upper portions 37,38. The flat lower portion 37 is connected to the bottom portion 23 of the frame 18 and extends from the lower orifice 33 and beyond the lower edge 39 of the lower orifice 33. Similarly, the flat upper portion 38 is connected to the upper frame portion 23 and extends therefrom and from the upper edge 40 of the upper orifice 34.

The orifices 33,34 are formed between the flat portions 37,38 of the enclosure portion 35 and lower and upper plate-like members 41,42, with the lower plate-like member 41 extending across the bottom 20 of the opening 19 from the bottom portion 23 of the frame 18 downstream above the flat lower portion 37. The lower plate-like member 41 has a downstream edge defining the upper edge of the lower orifice 33.

Similarly, the upper plate-like member 42 extends across the top surface 21 of the opening 19 from the top portion 25 of the frame 18 downstream below the flat upper portion 38. The upper plate-like member 42 has a downstream edge defining the lower edge of the upper orifice 34.

Figure 11:
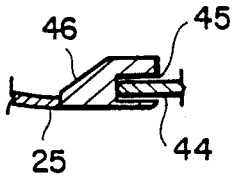
FIG. 11 is an enlargement of a portion of FIG. 10.

The lower and upper plate-like members 41,42 have their upstream edges 43,44, respectively, seated in downstream-facing slots 45, in bracket strips 46 (FIG. 11) secured to and extending transversely across the bottom and top portions 23 and 25 of the frame 18 generally tangentially with the bottom 20 and top surface 21 of the opening 19. The extent of the plate-like members 41,42 and their connection in the slots 45 of the bracket strips 46 permits adjustment of the plate-like members 41,42 to increase or decrease the spacing between the downstream edges and the flat upper and lower portions 37,38 to adjust the size of the orifices 33,34 in the direction of the rope path, with the orifices facing generally downstream to direct the liquor from the tubular bottom and top portions 23,25 between the flat lower and upper portions 37,38 and the lower and upper plate-like members 41,42 through the generally downstream facing orifices 33,34 to direct the liquor in a rope transporting direction.

To further facilitate application of the liquor onto the textile rope R, the flat lower and upper portions 37,38 of the enclosure portion 35 extend downstream at upward and downward inclinations, respectively, in a converging manner to direct liquor from the orifices 33,34 at an inclination toward the rope R. To further facilitate this, the lower and upper plate-like members 40,41 have their downstream outer extents 47,48, respectively, bent to be generally parallel with the inclination of the respective flat portions 37,38.

To confine the flow of liquor flowing to the upper orifice 34 and thereby facilitate adequate distribution of liquor through the tubular side portions 24 to the bottom portion 23 and lower orifice 33 formed therein, the flat upper portion 38 extends inwardly into the top portion 25 of the frame 18 above the upper orifice 34, thereby confining flow and distribution of liquor thereunder to the upper orifice 34.

Figure 10:
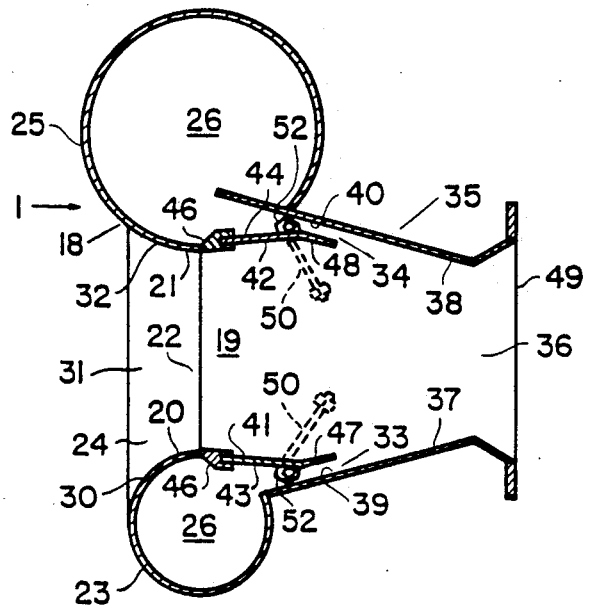
FIG. 10 is a sectional view of the right-hand portion of the liquid applying nozzle of FIG. 9.

As seen in FIG. 10, the flat lower and upper portions 37,38 flare outwardly at their downstream ends at which they are attached to a peripheral flange 49 for attachment to the return tube 16 to form a closed return path for the rope R from the nozzle 1 to the guide plate 17 at the rear of the machine 2.

The aforementioned independent adjustments of the sizes of the orifices 33,34 by adjustment of the plate-like members 41,42 is accomplished by adjusting means illustrated in FIGS. 6–10. This consists of an adjusting mechanism 50 at each end of each orifice. Each adjusting mechanism 50 includes a bolt 51 attached to an upstanding flange 52 at the side edge of the respective plate-like member 41,42. The bolt 51 projects outwardly through a slot 53 formed in the respective side plate 36 into an enlarged head 54 that is secured to a threaded adjusting rod 55 that extends along the exterior of the side plate 36 at a downstream inclination through an attaching bracket 56 in which it is positioned by opposing nuts 57 threaded on the rod 55 on opposite sides of the bracket 56. By adjusting the nuts 57 on the rod 55, the rod is adjusted to move the bolt 51 in the slot 53, which is enlarged to permit such movement, thereby adjusting the attached side of the plate-like member 41,42 toward and away from the flat portions 37,38 to decrease or increase the spacing therebetween and thereby adjust the size of the orifice 33,34.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. In a textile dyeing machine in which textile material, such as fabric, is circulated in rope form through a dyeing chamber and wherein the rope progresses in folded plug form through the chamber and is withdrawn from the leading end of the plug in a path extending over a lifter reel, through a liquor applying nozzle and a return passage from which it reforms as the trailing end of the progressing folded plug, said liquor applying nozzle comprising a frame surrounding the path of the textile rope and having an opening through which the textile rope passes, said frame being hollow for distribution of liquor therethrough, means for introducing treating liquor through said frame into said opening onto the textile rope, said liquor introducing means including a lower orifice extending transversely across the opening along the bottom thereof for flow of liquor therethrough into contact with a textile rope, said opening being defined by an elongated, generally straight, transversely extending surface forming the textile rope supporting bottom of the opening, a transversely extending top surface spaced from the bottom, and a pair of spaced, upstanding, generally straight side surfaces, said bottom and generally straight side surfaces combining to facilitate disposition of the textile rope in generally open condition across the transverse extent of the opening.

2. In a textile dyeing machine, a liquor applying nozzle according to claim 1 and characterized further in that said lower orifice faces generally downstream to direct the liquor in a rope transporting direction.

3. In a textile dyeing machine, a liquor applying nozzle according to claim 1 and characterized further in that said liquor introducing means includes means for adjusting the size of the lower orifice in the direction of the rope path.

4. In a textile dyeing machine, a liquor applying nozzle according to claim 1 and characterized further by an enclosure portion extending downstream from the lower orifice for enclosing the rope downstream of the orifice.

5. In a textile dyeing machine, a liquor applying nozzle according to claim 4 and characterized further in that said enclosure portion includes a generally flat lower portion extending downstream from the lower edge of the lower orifice.

6. In a textile dyeing machine, a liquor applying nozzle according to claim 5 and characterized further in that said liquor introducing means includes a lower plate-like member extending across the bottom of said opening and extending downstream above said flat lower portion and having a downstream edge defining the upper edge of the lower orifice.

7. In a textile dyeing machine, a liquor applying nozzle according to claim 6 and characterized further in that said platelike member is adjustable to adjust the spacing between the downstream edge thereof and the flat lower portion, and thereby adjust the size of the lower orifice.

8. In a textile dyeing machine, a liquor applying nozzle according to claim 5 and characterized further in that said flat portion extends downstream at an upward inclination to direct liquor from the lower orifice at an inclination toward the rope.

9. In a textile dyeing machine, a liquor applying nozzle according to claim 1 and characterized further in that said liquor introducing means includes an upper orifice extending transversely across the opening along the upper surface thereof for flow of liquor therethrough into contact with the textile rope.

10. In a textile dyeing machine, a liquor applying nozzle according to claim 9 and characterized further in that said liquor introducing means includes means for adjusting the size of the lower orifice in the direction of the rope path and means for adjusting the size of the upper orifice in the direction of the rope path independent of adjustment of the size of the lower orifice.

11. In a textile dyeing machine, a liquor applying nozzle according to claim 9 and characterized further by an enclosure portion extending downstream from the upper and lower orifices and including generally flat upper and lower portions extending downstream from the upper edge of the upper orifice and the lower edge of the lower orifice, respectively.

12. In a textile dyeing machine, a liquor applying nozzle according to claim 11 and characterized further in that said liquor introducing means includes a lower plate-like member extending across the bottom of the opening and extending downstream above said flat lower portion and having a downstream edge defining the upper edge of the lower orifice, and an upper plate-like member extending across the top of the opening and extending downstream below the flat upper portion and having a downstream edge defining the lower edge of the upper orifice.

13. In a textile dyeing machine, a liquor applying nozzle according to claim 12 and characterized further in that said platelike members are independently adjustable to adjust the spacings between their downstream edges and the respective flat upper and lower portions, and thereby independently adjust the sizes of the orifice.

14. In a textile dyeing machine, a liquor applying nozzle according to claim 11 and characterized further in that said flat upper and lower portions extend downstream at converging inclinations to direct liquor from the orifices at inclinations toward the rope.

15. In a textile dyeing machine, a liquor applying nozzle according to claim 11 and characterized further in that said frame includes hollow tubular bottom, side and top portions on which said bottom, side and top surfaces are formed, said bottom, side and top portions being connected to provide a liquor distribution plenum surrounding the path of the rope and communicating with the lower orifice.

16. In a textile dyeing machine, a liquor applying nozzle according to claim 15 and characterized further in that said bottom, side and top portions have upstream surfaces curved inwardly toward said opening for guiding the textile rope into the opening.

17. In a textile dyeing machine, a liquor applying nozzle according to claim 16 and characterized further in that said top portion includes a liquor receiving port for receiving liquor for distribution through the plenum to the lower orifice.

18. In a textile .dyeing machine, a liquor applying nozzle according to claim 15 and characterized further in that said liquor introducing means includes an upper orifice extending transversely across the opening along the upper surface thereof for flow of liquor from said top portion therethrough into contact with the textile rope.

19. In a textile dyeing machine, a liquor applying nozzle according to claim 18 and characterized further by an enclosure portion extending downstream from the upper and lower orifices and including generally flat upper and lower portions extending downstream from the upper edge of the upper orifice and the lower edge of the lower orifice, respectively, said flat upper portion extending inwardly into said top portion above the upper orifice to confine flow and distribution of liquor thereunder to the upper orifice.

* * * * *